US010727572B2

(12) United States Patent
Kim

(10) Patent No.: US 10,727,572 B2
(45) Date of Patent: Jul. 28, 2020

(54) ANTENNA APPARATUS AND VEHICLE HAVING THE SAME

(71) Applicants: Hyundai Motor Company, Seoul (KR); Kia Motors Corporation, Seoul (KR)

(72) Inventor: Dongjin Kim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 291 days.

(21) Appl. No.: 15/971,339

(22) Filed: May 4, 2018

(65) Prior Publication Data

US 2019/0173164 A1 Jun. 6, 2019

(30) Foreign Application Priority Data

Dec. 5, 2017 (KR) ..... 10-2017-0165591

(51) Int. Cl.

| | |
|---|---|
| ***H01Q 1/36*** | (2006.01) |
| ***H01Q 1/32*** | (2006.01) |
| ***H01Q 19/06*** | (2006.01) |
| ***H01Q 15/02*** | (2006.01) |
| ***H01Q 21/28*** | (2006.01) |
| ***H01Q 13/02*** | (2006.01) |

(52) U.S. Cl.

CPC ..... *H01Q 1/325* (2013.01); *H01Q 1/3233* (2013.01); *H01Q 1/36* (2013.01); *H01Q 13/02* (2013.01); *H01Q 15/02* (2013.01); *H01Q 19/06* (2013.01); *H01Q 21/28* (2013.01)

(58) Field of Classification Search

CPC ..... H01Q 1/325; H01Q 1/3233; H01Q 1/36; H01Q 13/02; H01Q 15/02; H01Q 19/06; H01Q 21/28

See application file for complete search history.

(56) References Cited

U.S. PATENT DOCUMENTS

| | | | |
|---|---|---|---|
| 6,433,751 | B1 | 8/2002 | Ishitobi et al. |
| 6,473,049 | B2 | 10/2002 | Takeuchi et al. |
| 2015/0346334 | A1 | 12/2015 | Nagaishi et al. |

FOREIGN PATENT DOCUMENTS

| | | | |
|---|---|---|---|
| JP | H03-178204 | A | 8/1991 |
| JP | H04-134909 | A | 5/1992 |
| JP | H07-99407 | A | 4/1995 |
| JP | 2012-013559 | A | 1/2012 |
| JP | 2015-138999 | A | 7/2015 |
| KR | 10-1999-0023895 | A | 3/1999 |
| KR | 10-2014-0049482 | A | 4/2014 |
| KR | 10-2017-0071385 | A | 6/2017 |

OTHER PUBLICATIONS

Feko. Printed May 3, 2018. "mmWave Axial Choke Horn Antenna with Lens." https://www.feko.info/applications/white-papers/mmwave-axial-choke-horn-antenna-with-lens/mmwave-axial-choke-horn-antenna-with-lens.

*Primary Examiner* — Graham P Smith
(74) *Attorney, Agent, or Firm* — Morgan, Lewis & Bockius LLP

(57) ABSTRACT

A vehicle may include a body provided with a front window and a rear window, a plurality of lenses formed on at least one of the front window and the rear window and provided with a first surface and a second surface, a plurality of antennae disposed on the second surface of the lens to radiate a radio signal passing through the plurality of lens, and a switcher configured to select at least one antenna among the plurality of antennae to allow the at least one antenna among the plurality of antennae to radiate the radio signal.

20 Claims, 13 Drawing Sheets

ANTENNA APPARATUS AND VEHICLE HAVING THE SAME

CROSS-REFERENCE TO RELATED APPLICATION(S)

The present application claims priority to Korean Patent Application No. 10-2017-0165591, filed on Dec. 5, 2017 in the Korean Intellectual Property Office, the entire contents of which is incorporated herein for all purposes by this reference.

BACKGROUND OF THE INVENTION

Field of the Invention

The present invention relates to an antenna apparatus and a vehicle having the same, more particularly to an antenna apparatus configured for generating various radiation patterns and a vehicle having the same.

Description of Related Art

A vehicle represents transportation means for driving in the road and railway using fossil fuel and electricity as a power source.

Recently, it has been common for the vehicle to include an audio device and a video device to allow a driver to listen to music and to watch a video, as well as to transport a cargo and people. Furthermore, a navigation system has been widely disposed in the vehicle to display a route to a destination which is desired by the driver.

Recently, there is a growing demand for the vehicle to communicate with an external device. For example, in the case of a navigation function to guide the route to the destination, information related to the traffic conditions of the road is required to find the optimal route. Since the traffic conditions are frequently changed, it may be required for the vehicle to acquire the information related to the traffic conditions in real time.

Furthermore, the system for the driver's safety has been actively developed, e.g., Forward Collision Warning System (FCWS) and Autonomous Emergency Braking (AEB) for ensuring the safety of the driver and for providing the convenience of the driver. The Forward Collision Warning System (FCWS) and Autonomous Emergency Braking (AEB) may estimate whether to collide with a proceeding vehicle and a collision estimated time based on location information related to the proceeding vehicle detected by a radar device.

A communication device configured for the communication with the external device and a radar device configured for the forward collision warning include an antenna apparatus configured to send and receive radio waves.

A vehicle antenna technology which is currently on the market is limited to a patch antenna array. This is because it is possible to implement a light weight and a thin antenna. However, as for the patch array antenna, there may be a dielectric loss caused by the use of a dielectric substrate and thus the performance of the antenna is significantly reduced due to the dielectric loss. In 5G communication technology or the radar using several tens GHz or more high frequency, the efficiency of the patch antenna is less than 30%. Furthermore, the patch array antenna utilizes a feeding structure in series and thus the patch array antenna has an extremely narrow frequency band characteristic.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an antenna apparatus configured for radiating radio waves in various beam shapes and in various directions, by use of a lens and a vehicle having the same.

Various aspects of the present invention are directed to providing an antenna apparatus configured for radiating radio waves in various beam shapes and in various directions, by use of a window of vehicle and a vehicle having the same.

Additional aspects of the present invention will be set forth in portion in the description which follows and, in part, will be obvious from the description, or may be learned by practice of the present invention.

In accordance with one aspect of the present invention, a vehicle may include a body provided with a front window and a rear window, a plurality of lenses formed on at least one of the front window and the rear window and provided with a first surface and a second surface, a plurality of antennae disposed on the second surface of the lens to radiate a radio signal passing through the plurality of lenses, and a switcher configured to select at least one antenna among the plurality of antennae to allow the at least one antenna among the plurality of antennae to radiate the radio signal.

The plurality of lenses may be integrally formed with at least one of the front window and the rear window.

The first surface of the plurality of lenses may be a convex surface and the second surface of the plurality of lenses may be a flat surface.

A radiation direction thereof, in which each of the plurality of antennae radiates a radio signal, may be different from each other.

Each of the plurality of antennae may radiate a radio signal toward a predetermined point in the front side of the body.

The plurality of antennae may include a first antenna, a second antenna disposed on the left side of the first antenna, and a third antenna disposed on the right side of the first antenna. The first antenna may radiate a radio signal to the front side of the body. The second antenna may radiate a radio signal to the front right side of the body. The third antenna may radiate a radio signal to the front left side of the body.

The plurality of antennae radially may radiate a radio signal to the front side of the body.

The plurality of antennae may include a first antenna, a second antenna disposed on the left side of the first antenna, and a third antenna disposed on the right side of the first antenna. The first antenna may radiate a radio signal to the front side of the body. The second antenna may radiate a radio signal to the front left side of the body. The third antenna may radiate a radio signal to the front right side of the body.

The first surface of each of the plurality of lenses may be a convex surface. A radius of curvature of the convex surface of the plurality of lenses may be different from each other.

A diameter of each of the plurality of lenses may be different from each other.

In accordance with one aspect of the present invention, an antenna apparatus for a vehicle may include a plurality of lenses formed on at least one of a front window and a rear window of the vehicle and provided with a first surface and a second surface, a plurality of antennae disposed on the second surface of the lens and to radiate a radio signal passing through the plurality of lens, and a switcher configured to select at least one antenna among the plurality of antennae to allow the at least one antenna among the plurality of antennae to radiate a radio signal.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
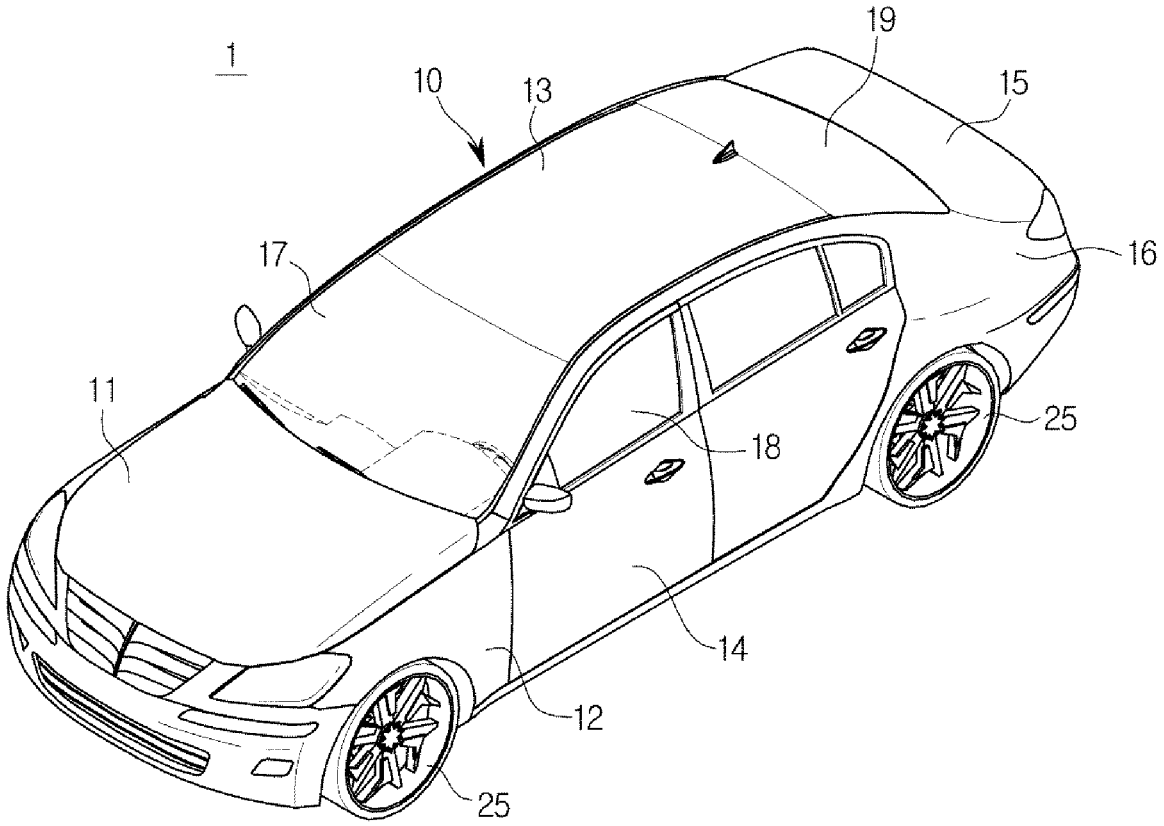
FIG. 1 is a view illustrating a vehicle body in accordance with an exemplary embodiment of the present invention.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the contrary, the invention(s) is/are intended to cover not only the exemplary embodiments of the present invention, but also various alternatives, modifications, equivalents and other embodiments, which may be included within the spirit and scope of the invention as defined by the appended claims.

Figure 2:
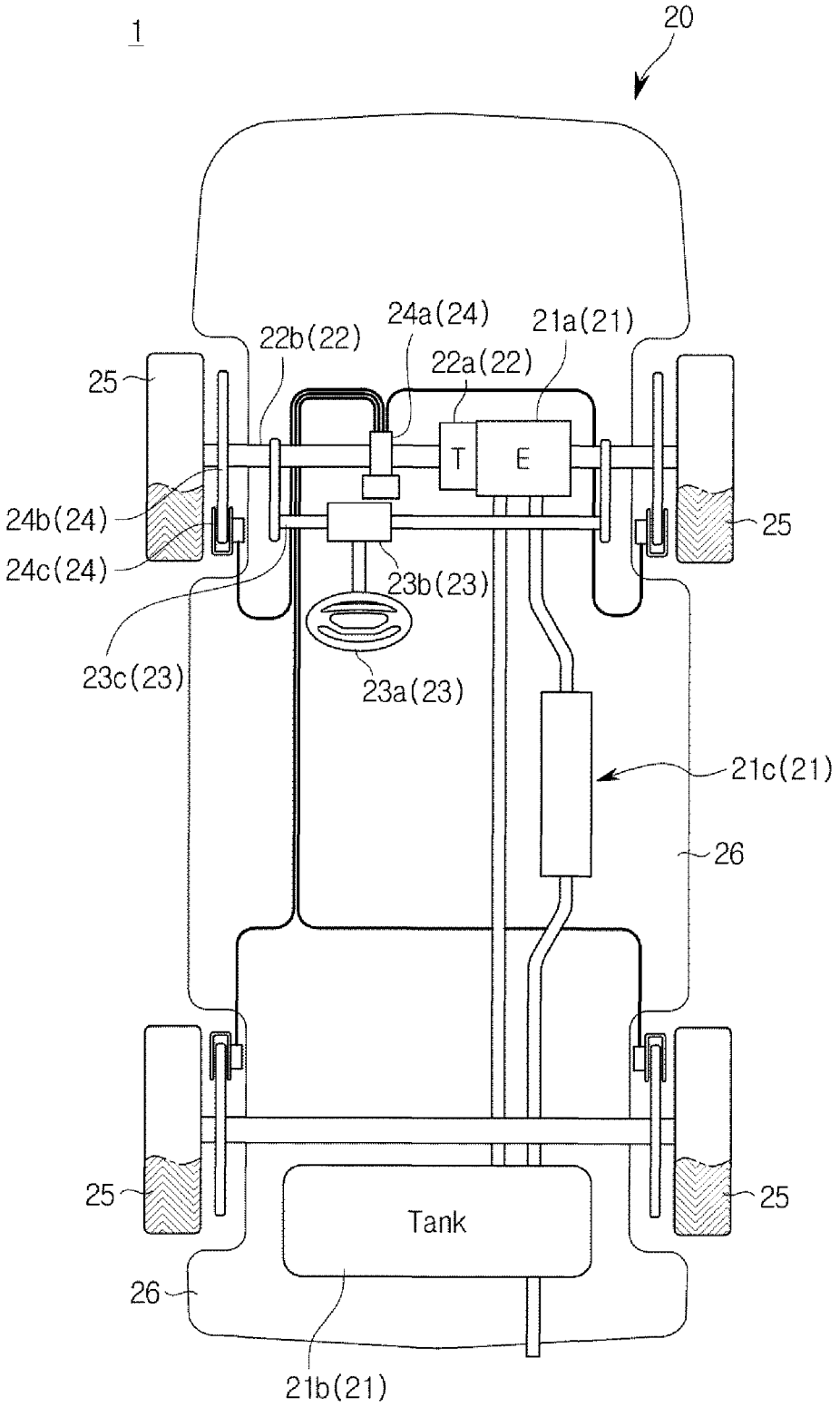
FIG. 2 is a view illustrating a chassis of the vehicle in accordance with an exemplary embodiment of the present invention.
Figure 3:
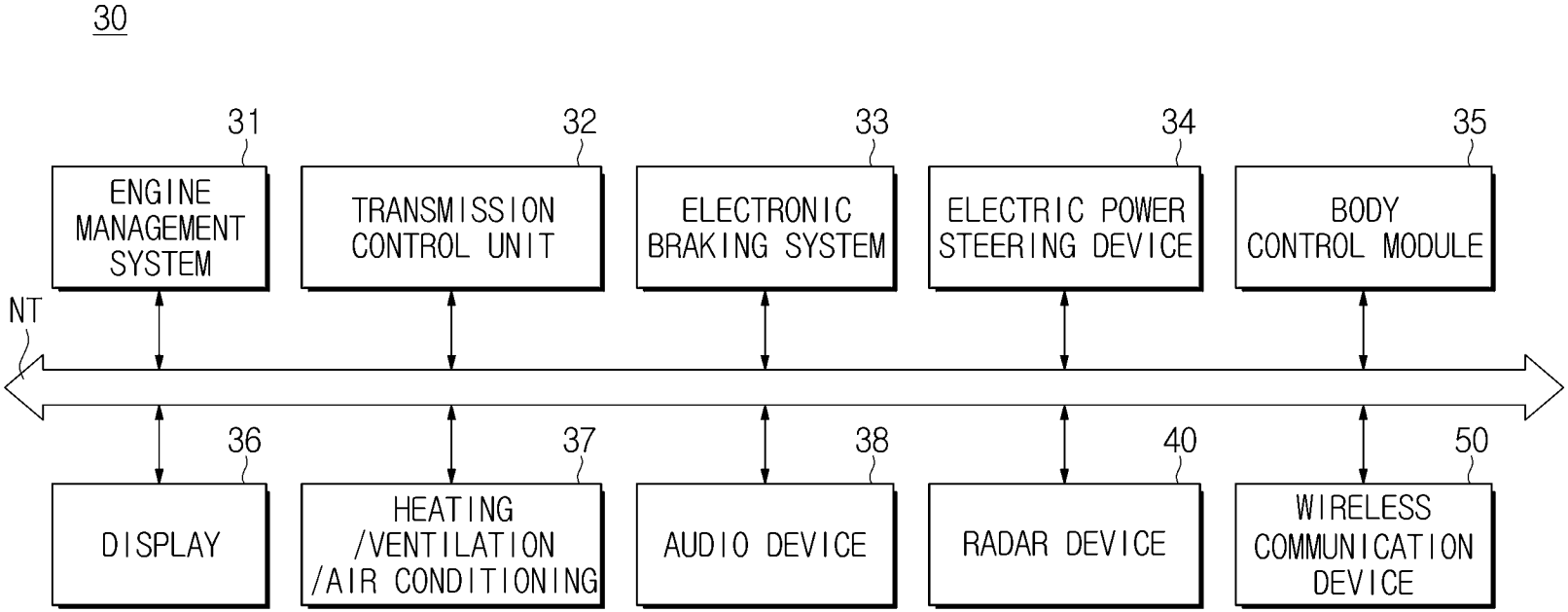
FIG. 3 is a view illustrating electrical components of the vehicle in accordance with an exemplary embodiment of the present invention.

FIG. 1 is a view illustrating a vehicle body in accordance with an exemplary embodiment of the present invention. FIG. 2 is a view illustrating a chassis of the vehicle in accordance with an exemplary embodiment of the present invention. FIG. 3 is a view illustrating electrical components of the vehicle in accordance with an exemplary embodiment of the present invention.

Referring to FIG. 1, FIG. 2, and FIG. 3, a vehicle 1 may include a body 10 forming an external of the vehicle 1 and accommodating a driver and/or baggage, a chassis 20 including components of the vehicle 1 except the body 10, and electrical components 30 protecting a driver and providing the convenience to the driver.

Referring to FIG. 1, the body 10 may form an interior space in which a driver is placed, an engine compartment in which an engine is placed, and a trunk compartment in which baggage is placed.

The body 10 may include a hood 11; a front fender 12; a roof panel 13; a door 14; a trunk lid 15; and a quarter panel 16. To provide a view to a driver, a front window 17 may be disposed in the front side of the body 10 and a side window 18 may be disposed in a lateral side of the body 10. Furthermore, a rear window 19 may be disposed in the rear side of the body 10.

Referring to FIG. 2, to drive the vehicle 1 according to driver's control, the chassis 20 may include a power system 21; a power train 22; a steering system 23; a brake system 24; a vehicle wheel 25; and a frame 26.

The power system 21 may be configured to generate a torque to drive the vehicle 1 according to the acceleration control of the driver and include an engine 21*a*, a fuel device 21*b*, an exhaust system 21*c*, and an acceleration pedal.

The power train 22 may be configured to transmit the torque generated by the power system 21 to the vehicle wheel 25 and include a clutch/transmission 22*a*, a driveshaft 22*b*, and a shift lever 22*c*.

The steering system 23 may be configured to change a driving direction of the vehicle 1 according to the steering control of the driver and include a steering wheel 23*a*, a steering gear 23*b*, and a steering link 23*c*.

The brake system 24 may be configured to stop a driving of the vehicle 1 according to the brake control of the driver and include a master cylinder 24*a*, a brake disk 24*b*, and a brake pad 24*c* and a brake pedal.

The vehicle wheel 25 may receive the torque from the power system 21 through the power train 22 and move the vehicle 1. The vehicle wheel 25 may include a front wheel provided in the front side of the vehicle, and a rear wheel provided in the rear side of the vehicle.

The frame 26 may fix the power system 21; the power train 22; the steering system 23; the brake system 24; and the vehicle wheel 25.

For the control of the vehicle 1 and the safety and convenience of the passenger and the driver, the vehicle 1 may include a variety of electrical components 30 of the vehicle 1, as well as the above mentioned mechanical devices.

Referring to FIG. 3, the vehicle 1 may include an engine management system (EMS) 31, a transmission control unit (TCU) 32, an electronic braking system (EBS) 33, an electric power steering (EPS) device 34, a body control module (BCM) 35, a display 36, a heating/ventilation/air conditioning (HVAC) device 37, an audio device 38, a wireless communication device 50, and a radar device 40.

The engine management system 31 may control the operation of the engine and manage the engine in a response to the driver's acceleration command through the accelerator pedal 21*d*. For example, the engine management system 31 may perform engine torque control, fuel consumption control, engine failure diagnosis, and/or generator control.

The transmission control unit 32 may control the operation of the transmission in a response to the shift command of the driver through the shift lever 22*c* or the driving speed of the vehicle 1. For example, the transmission control unit 32 may perform clutch control, shift control, and/or engine torque control during a shift.

The electronic braking system 33 may control the braking device of the vehicle 1 in a response to the driver's braking command through the braking pedal 24*d* and maintain the balance of the vehicle 1. For example, the electronic braking system 33 may perform automatic parking braking, slip prevention during braking, and/or slip prevention during steering.

The electric power steering device 34 may assist the driver so that the driver can easily operate the steering wheel 23*a*. For example, the electric power steering device 34 may assist the driver in steering operations such as reducing the steering force during low-speed driving or parking, and increasing the steering force during high-speed driving.

The body control module 35 may control the operation of the electric components that provide convenience to the driver or ensure the safety of the driver. For example, the body control module 35 may control a door lock device, a head lamp, a wiper, a power seat, a seat heater, a cluster, an interior lamp, a navigation device, and a multifunctional switch.

The display 36 may be disposed in the center fascia within the vehicle 1 and provide various information and fun to the driver through an image. For example, the display 36 may reproduce a video file stored in an internal storage medium or an external storage medium according to a command from the driver, and output an image included in the video file. Furthermore, the display 36 may receive the destination from the driver through the touch input of the driver, and may display the route to the input destination.

The heating/ventilation/air conditioning (HVAC) device 37 may heat or cool the interior air according to an interior temperature of the vehicle 1 and a target temperature inputted by the driver. For example, the heating/ventilation/air conditioning (HVAC) device 37 may cool interior air when an interior temperature is higher than the target temperature, and may heat the interior air when the interior temperature is lower than the target temperature. The heating/ventilation/air conditioning (HVAC) device 37 may introduce air from the outside of the vehicle 1 into the inside of the vehicle 1 or circulate the internal air of the vehicle 1 by blocking the introduction of the external air.

The audio device 38 may provide various information and fun to the driver through the sound. For example, the audio device 38 may reproduce an audio file stored in an internal storage medium or an external storage medium according to a command from the driver, and output sound contained in the audio file. Furthermore, the audio device 38 may receive an audio broadcast signal and output a sound corresponding to the received audio broadcast signal.

The radar device 40 may detect an obstacle or another vehicle in front, rear and lateral side of the vehicle 1. The radar device 40 may be used for a forward collision avoidance function, a lane departure warning function, a blind spot detection function, and a rear detection function. For example, the radar device 40 may include Forward Collision Warning System (FCW), Advanced Emergency Braking System (AEBS), Adaptive Cruise Control (ACC), Lane Departure Warning System (LDWS), Lane Keeping Assist System (LKAS), Blind Spot Detection (BSD) and Rear-end Collision Warning System (RCW).

The wireless communication device 50 may communicate with another vehicle, a user's terminal or a communication relay device through a wireless communication technology. The wireless communication device 38 may be used for a vehicle to vehicle communication (V2V communication), a vehicle to infrastructure communication (V2I communication), a vehicle to nomadic devices communication (V2N communication), and a vehicle to grid communication (V2G communication)

The wireless communication device 50 may transmit and receive a signal by use of a variety of communication protocols. For example, the wireless communication device 50 may employ 2G communication method, e. g. Time Division Multiple Access (TDMA) and Code Division Multiple Access (CDMA), 3G communication method, e. g. Wide Code Division Multiple Access (WCDMA), Code Division Multiple Access (CDMA) 2000, Wireless Broadband (Wibro), and World Interoperability for Microwave Access (WiMAX), and 4G communication method, e. g. Long Term Evolution (LTE) and Wireless Broadband Evolution. Furthermore, the wireless communication device 50 may employ 5G communication method.

Furthermore, to provide convenience to the driver or ensure the safety of the driver of the vehicle 1, the vehicle 1 may further include electrical components. For example, the vehicle 1 may include electrical components 30 such as a door lock device, a head lamp, a wiper, a power seat, a seat heater, a cluster, an interior lamp, a navigation device, and a multifunctional switch.

The electrical components 30 may communicate with each other via a vehicle communication network (NT). For example, the electrical components 30 may send and receive data through Ethernet, Media Oriented Systems Transport (MOST), FlexRay, Controller Area Network (CAN), and Local Interconnect Network (LIN).

Figure 4:
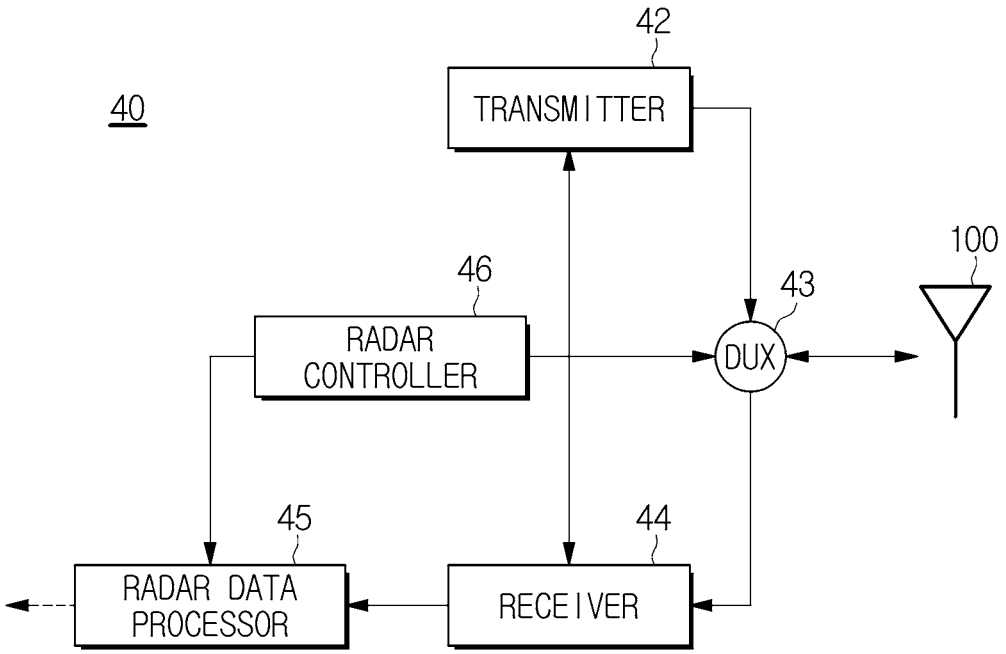
FIG. 4 is a view illustrating an example of a radar device included in the vehicle in accordance with an exemplary embodiment of the present invention.

FIG. 4 is a view illustrating an example of a radar device included in the vehicle in accordance with an exemplary embodiment of the present invention.

As illustrated in FIG. 4, the radar device 40 may include a transmitter 42; a duplexer 43; a receiver 44; a radar data processor 45; a radar controller 46; and an antenna apparatus 100.

The transmitter 42 may generate a radio frequency transmission signal using a radio frequency (RF) signal of local oscillator.

The duplexer 43 may provide the radio frequency transmission signal received from the transmitter 42 to the antenna apparatus 100, or a reflection signal of the radio frequency received from the antenna apparatus 100 to the receiver 44.

The receiver 44 may extract radar data from the reflection signal received from the duplexer 43 using the radio frequency (RF) signal of the local oscillator.

The radar data processor 45 may extract location information related to an object by processing the radar data received from the receiver 44.

The radar controller 46 may control an operation of the transmitter 42, the duplexer 43, the receiver 44, the radar data processor 45 and the antenna apparatus 100.

The antenna apparatus 100 may radiate the radar signal received from the duplexer 43 to a free space and then provide a reflection signal received from the free space to the duplexer 43.

As mentioned above, the radar device 40 may radiate the radio frequency transmission signal to the free space via the antenna apparatus 100, and estimate location information related to the object by acquiring a reflection signal reflected from the object via the antenna apparatus 100.

Figure 5:
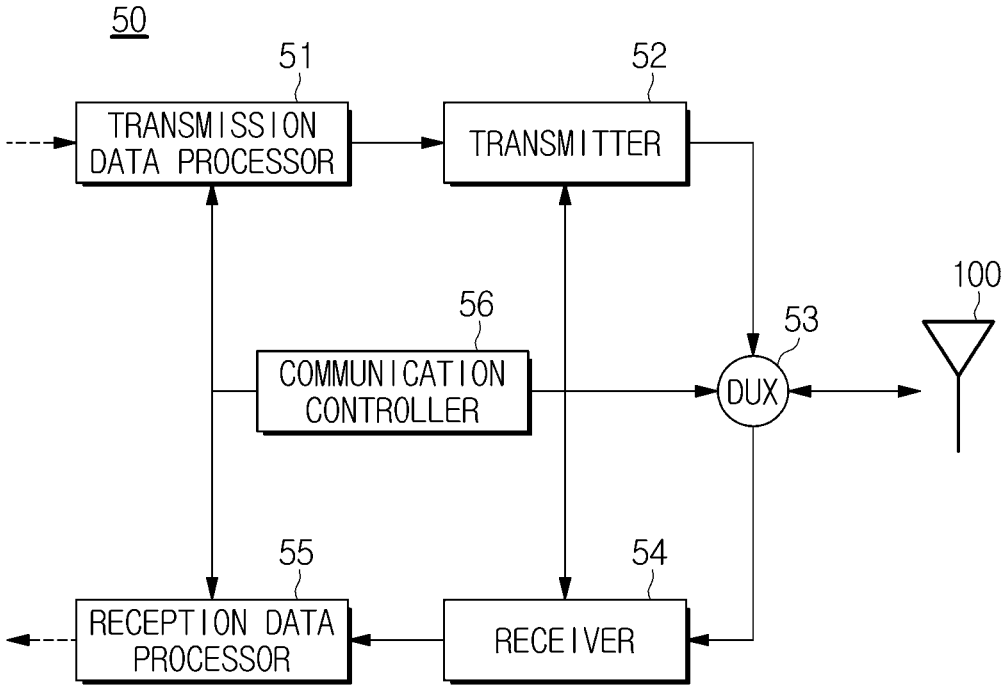
FIG. 5 is a view illustrating an example of a wireless communication device included in the vehicle in accordance with an exemplary embodiment of the present invention.

FIG. 5 is a view illustrating an example of a wireless communication device included in the vehicle in accordance with an exemplary embodiment of the present invention.

Referring to FIG. 5, the wireless communication device 50 may include a transmission data processor 51; a transmitter 52; a duplexer 53; a receiver 54; a reception data processor 55; a communication controller 56; and an antenna apparatus 100.

The transmission data processor 51 may convert digital transmission data received from another electronic device into a low frequency transmission signal, and provide the low frequency transmission signal to the transmitter 52.

The transmitter 52 may modulate the low frequency transmission signal into a radio frequency transmission signal using a radio frequency (RF) signal of local oscillator.

The duplexer 53 may provide the radio frequency transmission signal received from the transmitter 52 to the antenna apparatus 100, or a radio frequency reception signal received from the antenna apparatus 100 to the receiver 54.

The receiver 54 may demodulate the radio frequency reception signal received from the duplexer 53 using the radio frequency (RF) signal of the local oscillator.

The reception data processor 55 may convert a low frequency reception signal received from the receiver 54 into digital reception data.

The communication controller 56 may control an operation of the transmission data processor 51, the transmitter 52, the duplexer 53, the receiver 54, the reception data processor 55 and the antenna apparatus 100.

The antenna apparatus 100 may radiate the radar signal received from the duplexer 53 to a free space and then provide a reflection signal received from the free space to the duplexer 53.

As mentioned above, the wireless communication device 50 may transmit the radio frequency transmission signal to an external device via the antenna apparatus 100, and receive the radio frequency reception signal from the external device via the antenna apparatus 100.

The radar device 40 and the wireless communication device 50 may include the antenna apparatus 100 in common and the configuration and function of the antenna apparatus 100 of the radar device 40 and the antenna apparatus 100 of the wireless communication device 50 may be substantially identical to each other.

The performance of the radar device 40 and the wireless communication device 50 may be determined by the property of the antenna apparatus 100. For example, when using millimeter wave in which a frequency is 30-300 GHz (Giga Hertz) and a wavelength is 10-1 mm, the performance of the radar device 40 and the wireless communication device 50 may substantially depend on the property of the antenna apparatus 100.

Furthermore, an array antenna may be used for improving the performance of the antenna apparatus 100.

Hereinafter an antenna apparatus included in the vehicle according to one exemplary embodiment will be described.

Figure 6:
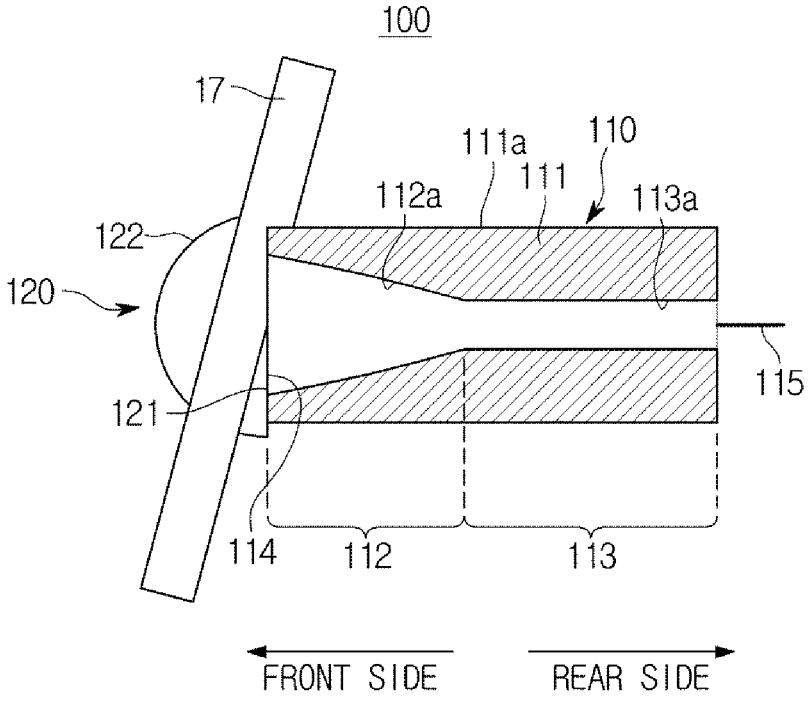
FIG. 6 is a view illustrating an antenna apparatus in accordance with an exemplary embodiment of the present invention.
Figure 7:
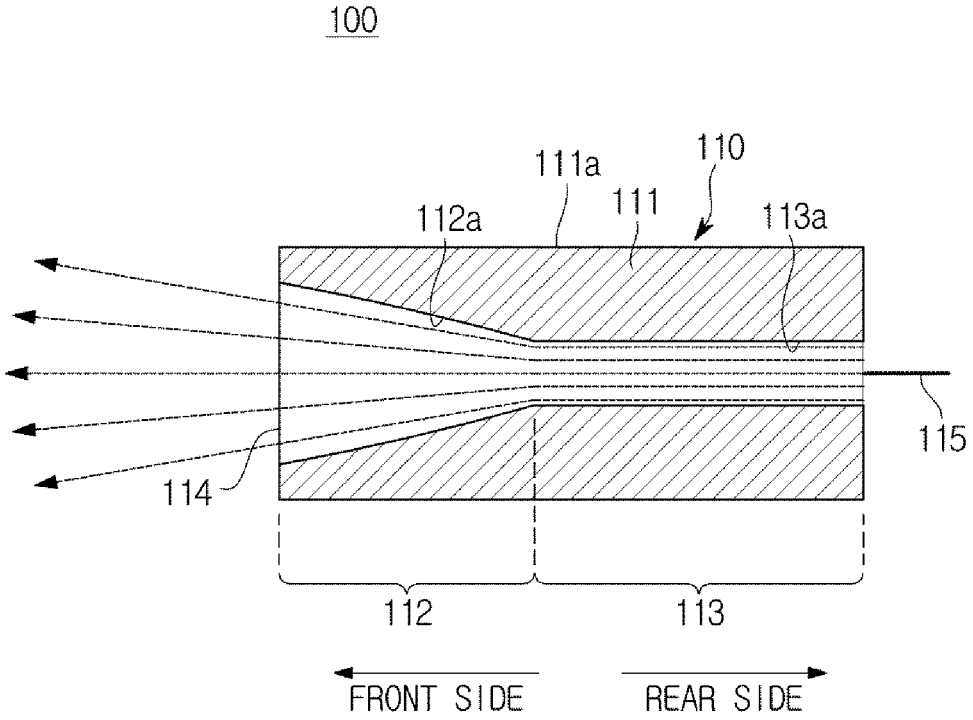
FIG. 7 is a view illustrating a traveling direction of a radio signal radiated from an antenna structure.
Figure 8:
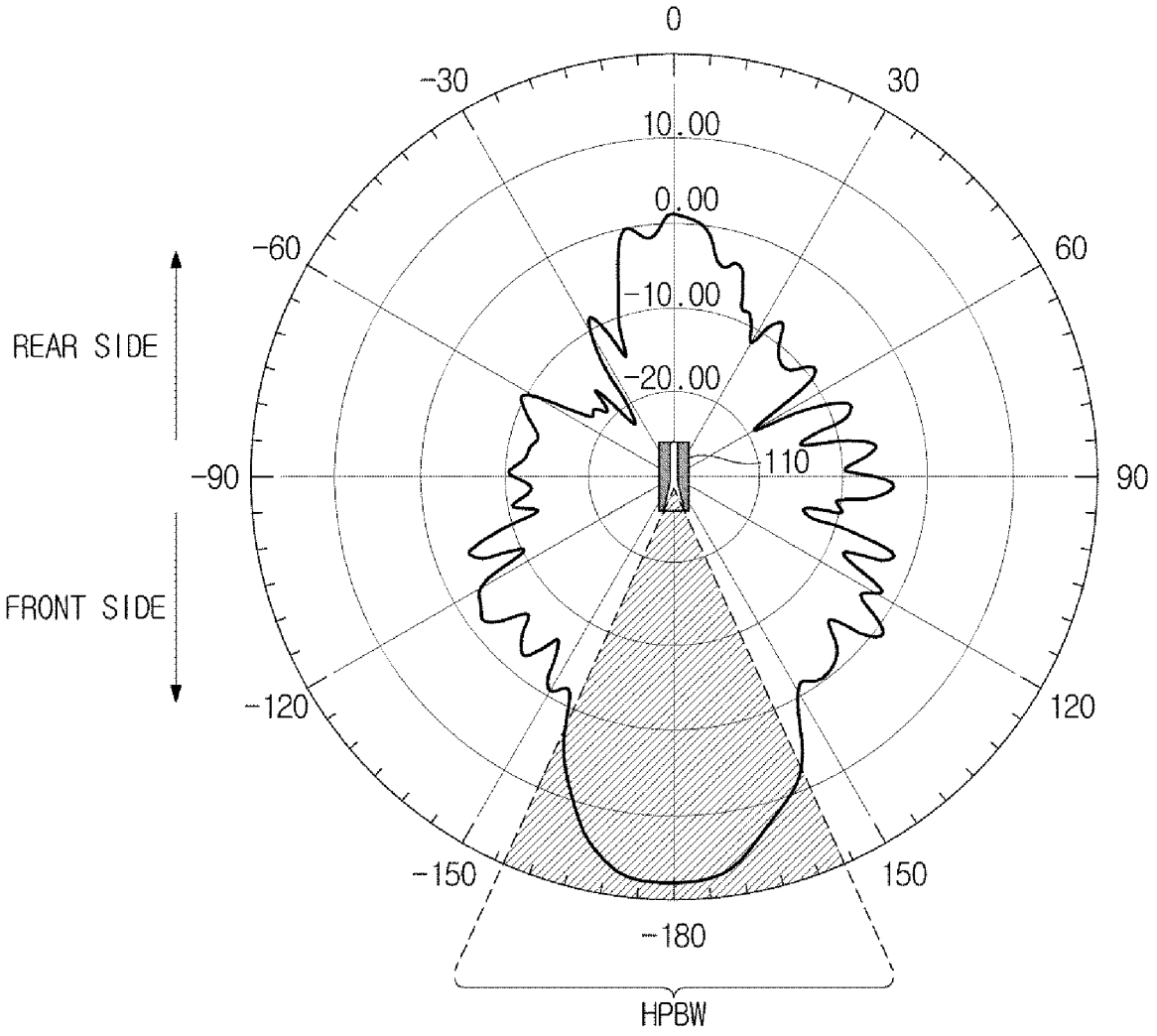
FIG. 8 is a view illustrating a radiation pattern of a radio signal radiated from the antenna structure.
Figure 9:
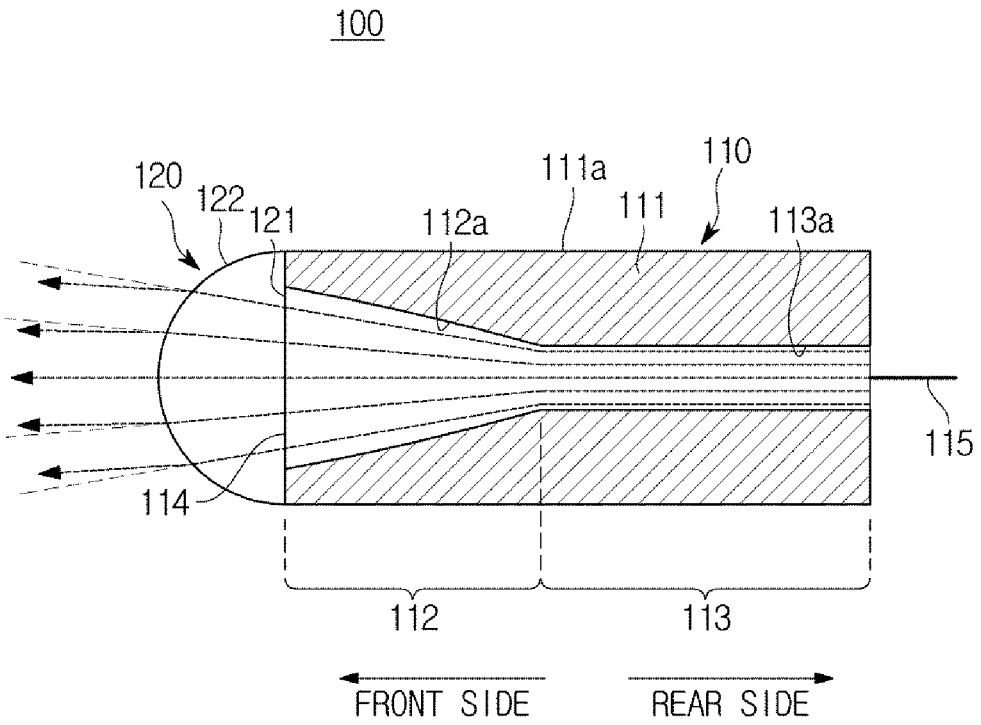
FIG. 9 is a view illustrating a traveling direction of a radio signal radiated from the antenna apparatus in accordance with an exemplary embodiment of the present invention.
Figure 10:
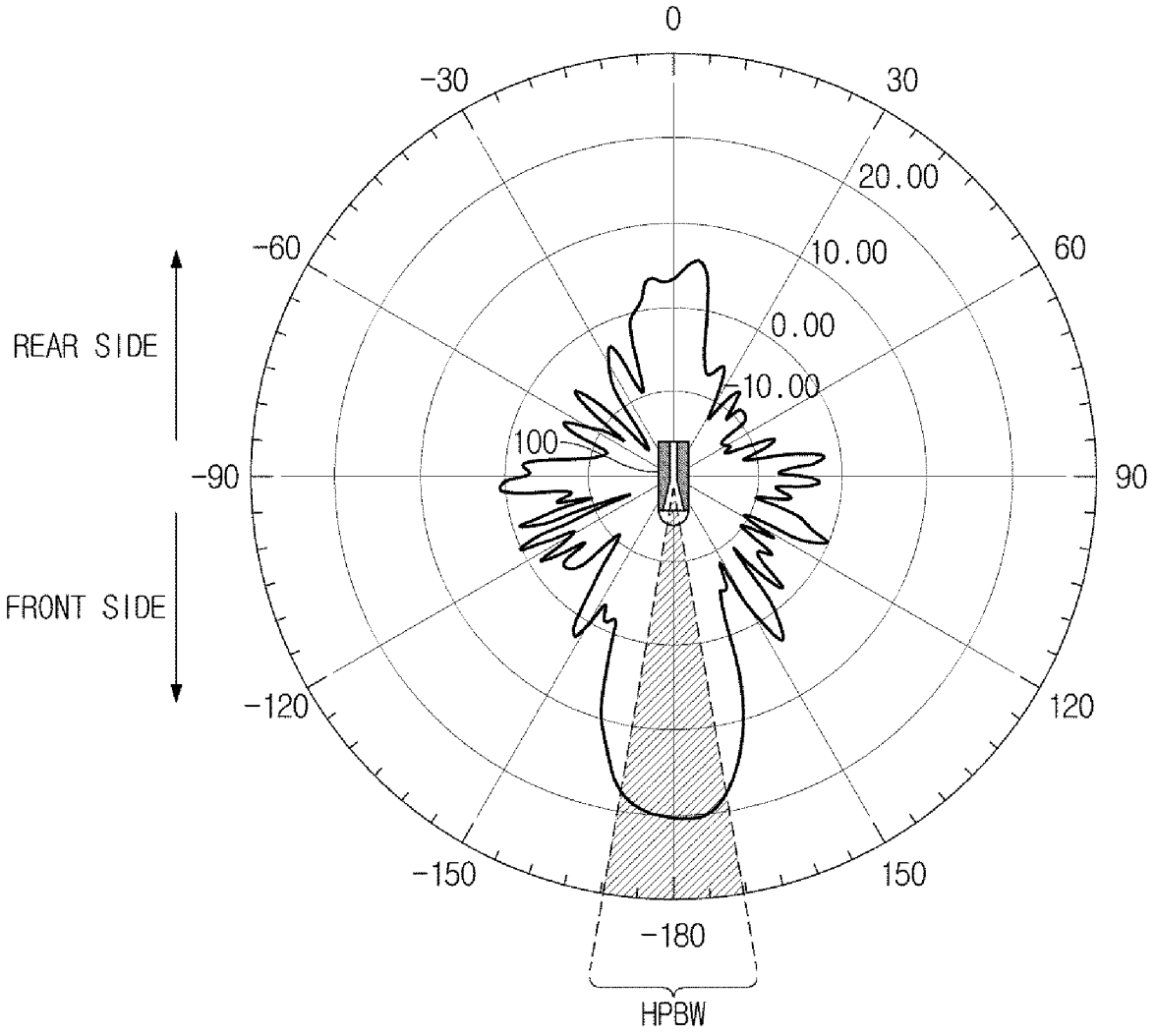
FIG. 10 is a view illustrating a radiation pattern of a radio signal radiated from the antenna apparatus.

FIG. 6 is a view illustrating an antenna apparatus in accordance with an exemplary embodiment of the present invention. FIG. 7 is a view illustrating a traveling direction of a radio signal radiated from an antenna structure. FIG. 8 is a view illustrating a radiation pattern of a radio signal radiated from the antenna structure. FIG. 9 is a view illustrating a traveling direction of a radio signal radiated from the antenna apparatus in accordance with an exemplary embodiment of the present invention. FIG. 10 is a view illustrating a radiation pattern of a radio signal radiated from the antenna apparatus.

Referring to FIGS. 6 to 10, an antenna apparatus 100 may include an antenna structure 110 transmitting and receiving a radio frequency signal and a lens 120 refracting a radio frequency signal.

The antenna structure 110 may be a horn antenna as shown in FIG. 6. The horn antenna has a structure in which a cross section of the waveguide is gradually widened like a horn. Furthermore, the horn antenna guides a radio wave to an aperture while slowly widening the internal to the waveguide through which the radio wave is transmitted, and radiates the radio wave from the aperture into the free space. However, the antenna structure 110 is not limited to the horn antenna, and various types of antennae may be employed. For example, the antenna structure 110 may include a waveguide antenna, a slot antenna, an array antenna and an aperture antenna.

The antenna structure 110 may include an antenna body 111 in which a hollow is formed. The antenna body 111 may include an internal surface 112*a* and 113*a* and an external surface 111*a*.

FIG. 6 illustrates the antenna body 111 formed in a cylindrical shape having a hollow, but is not limited thereto. The antenna body 111 may be formed in various shapes such as a polygonal pillar, a cone, and a polygonal pyramid.

Furthermore, the antenna body 111 may be formed of a conductive material through which electricity can flow. Alternatively, the antenna body 111 may be formed of non-conductive material through which electricity does not flow, and the internal surface 112*a*, and 113*a* and the external surface 111*a* of the antenna body 111 may be formed of a conductive material through which electricity can flow.

A hollow may be formed inside the antenna structure 110, and the hollow may be formed by penetrating the antenna structure 110. A cross section of the hollow may be widened from one side of the antenna structure 110 to the other side of the antenna structure 110. In other words, the hollow may have the shape of a polygonal pyramid or a cone. Furthermore, at one side of the antenna structure 110, a radiating aperture 114 through which a radio frequency signal is radiated into the free space, may be provided.

A length and a cross-sectional area of the antenna structure 110 (e.g., a diameter in a case of a circular shape, and a horizontal and vertical length in a case of a polygon), a cross-sectional area of the hollow (e.g., a diameter in a case of a circular shape, and a horizontal and vertical length in a case of a polygon), and a cross-sectional area of the radiating aperture 114 (e.g., a diameter in a case of a circular shape, and a horizontal and vertical length in a case of a polygon) may vary according to the frequency of the radio signal.

Furthermore, the hollow provided internal to the antenna structure 110 may include a radiating portion 112 radiating a radio frequency signal (electromagnetic waves or radio waves) to a free space, and a transmitting portion 113 guiding the radio frequency signal to the radiating portion 112.

The transmitting portion 113 may be in a form of a cylinder or a polygonal pillar. Furthermore, the transmitting portion 113 may correspond to a hollow disposed inside the antenna structure 110 and surrounded by the internal surface 113*a* of the antenna body 111.

A feeding pin 115 may be provided on one side of the transmitting portion 113. The feeding pin 115 may receive a feeding signal of a radio frequency from the radar device 40 or the wireless communication device 50, and radiate a radio frequency signal corresponding to the received feeding signal, to the transmitting portion 113.

The transmitting portion 113 may guide the radio frequency signal radiated from the feeding pin 115, to the radiating portion 112.

The radiating portion 112 may be in a form of a cone or a polygonal pyramid. Furthermore, the radiating portion 112 may correspond to a hollow disposed inside the antenna structure 110 and surrounded by the internal surface 112*a* of the antenna body 111.

One side of the radiating portion 112 may be connected to the transmitting portion 113 and the radiating aperture 114 may be disposed in the other side of the radiating portion 112.

The radiating portion 112 may guide a radio frequency signal transmitted from the transmitting portion 113, to the radiating aperture 114. In the present time, since the radiating portion 112 may be in a form of a cone or polygonal pyramid, the radio signal may be diffused along the radiating portion 112 and then radiated from the radiating aperture 114. In other words, the radio signal may be transmitted along the internal surface 112*a* of the radiating portion 112 and since the internal surface 112*a* of the radiating portion 112 has a cone or a polygonal pyramid shape, the radio signal may be diffused from the radiating aperture 114 to the lateral surface of the antenna structure 110 and then radiated to the front side of the antenna structure 110.

For example, as shown in FIG. 7, the radio signal may be radiated from the feeding pin 115 to the transmitting portion 113. In the transmitting portion 113, the radio signal may travel in parallel with the internal surface 113*a* of the transmitting portion 113 along the internal surface 113*a* of the transmitting portion 113.

Furthermore, the radio signal may be transmitted to the radiating portion 112 from the transmitting portion 113. A radio signal adjacent to the internal surface 112*a* of the radiating portion 112, i.e., a radio signal transmitted from an edge portion of the radiating portion 112, may travel in parallel with the internal surface 112*a* of the radiating portion 112 along the internal surface 112*a* of the radiating portion 112, and a radio signal away from the internal surface 112*a* of the radiating portion 112, i.e., a radio signal transmitted from the center of the radiating portion 112, may travel along the center of the antenna structure 110 while maintaining a traveling direction in the transmitting portion 113.

The radio signal transmitted from an edge portion of the radiating portion 112 may travel while spreading to the lateral side of the antenna structure 110 along the internal surface 112*a* of the radiating portion 112. The radio signal transmitted from the center of the radiating portion 112, may travel to the front side of the antenna structure 110.

As a result, the radiation pattern of the antenna structure 110, which is a horn antenna, may be as shown in FIG. 8.

As illustrated in FIG. 8, a radio signal radiated from the antenna structure 110 may be mostly radiated to the front side of the antenna structure 110, and some of the radio signal may be radiated while being spread to the lateral side of the antenna structure 110.

At the present time, the maximum gain of the antenna structure 110 and the half-power beam-width (HPBW) of the antenna structure 110 indicating the directivity of the radiation pattern is 17 dBi (decibels relative to an isotropic antenna) and 35 degrees, respectively.

As illustrated in FIG. 6, the lens 120 may be a plano-convex lens. The plano-convex lens is a type of convex lens, which is a single lens in which one surface is flat and the other surface is convex. However, the lens 120 is not limited to the plano-convex lens. The lens 120 may employ a symmetrical double convex lens, an asymmetrical double convex lens, and a positive meniscus lens. A central axis of the lens 120 may substantially coincide with a central axis of the antenna structure 110.

The lens 120 may be formed of a transparent material and may include a first surface 121 which is flat and a second surface 122 which is convex. The lens 120 may be formed of a material having an index of refraction higher than the index of refraction of the air. For example, the lens 120 may be formed of glass or a synthetic resin.

The lens 120 may be disposed in the windows 17, and 19 of the vehicle 1. For example, the lens 120 may be disposed in the front window 17 and/or the rear window 19 of the vehicle 1. The lens 120 may be formed separately from the window 17 and 19 of the vehicle 1 and then attached to the window 17 and 19 of the vehicle 1. Alternatively, the lens 120 may be integrally formed with the window 17 and 19 of the vehicle 1. In other words, the lens 120 of the antenna apparatus 100 may be formed by processing the window 17 and 19 of the vehicle 1.

As described above, by attaching the lens 120 to the windows 17 and 19 of the vehicle 1 or alternatively by integrally manufacturing the windows 17 and 19 of the vehicle 1 with the lens 120, it may be possible to prevent the diffraction, reflection, or attenuation of the radio signal (electromagnetic waves or radio waves) by the windows 17 and 19 of the vehicle 1.

The first surface 121 of the lens 120 may face the radiating aperture 114 of the antenna structure 110, and a radio signal (electromagnetic waves or radio waves) radiated from the radiating aperture 114 may penetrate the first surface 121 and then travel to the internal to the lens 120.

At the present time, the radio signal may penetrate the first surface 121 while spreading to the lateral side of the antenna structure 110 along the internal surface 112*a* of the radiating portion 112. Furthermore, the radio signal may be refracted by the first surface 121 during penetrating the first surface 121. Since the first surface 121 is flat, the position of the radio signal has no significant effect on the traveling direction of the refracted radio signal.

The second surface 122 of the lens 120 may be a convex surface recessed toward the front side of the antenna structure 110, and a radio signal passing through the internal to the lens 120 may be radiated to the free space through the second surface 122.

At the present time, the radio signal may travel internal to the lens 120 in the same manner as the internal to the radiating portion 112. In other words, in the lens 120, the radio signal may travel while spreading to the lateral side from the central axis of the antenna structure 110.

The radio signal may be refracted by the second surface 122 while passing through the second surface 122. In the present time, since the second surface 122 is a convex surface, a traveling direction of the refracted radio signal may vary according to the position.

For example, as illustrated in FIG. 9, the radio signal transmitted from the center of the radiating portion 112 may travel to the front side of the antenna structure 110 (a central axis direction) after passing through the second surface 122 of the lens 120.

Furthermore, the radio signal transmitted from the edge portion of the radiating portion 112 may be refracted after passing through the second surface 122 of the lens 120, and travel to the front side of the antenna structure 110 (a central axis direction). In other words, the radio signal transmitted from the edge portion of the radiating portion 112 may be more focused toward the front side of the antenna structure 110 by the lens 120.

As a result, the radiation pattern of the antenna apparatus 100 including the lens 120 and the antenna structure 110 may be as shown in FIG. 10.

Referring to FIG. 10, most of radio signals radiated from the antenna apparatus 100 may be radiated to the front side of the antenna apparatus 100, and some of the radio signals may be radiated while spreading to the lateral side of the antenna apparatus 100.

At the present time, the maximum gain of the antenna structure 110 and the half-power beam-width (HPBW) of the antenna structure 110 indicating the directivity of the radiation pattern is 20 dBi and 18 degrees, respectively.

In comparison between FIG. 8 and FIG. 10, the radio signal (electromagnetic waves or radio waves) radiated from the antenna structure 110 and the radio signal radiated from the antenna apparatus 100 may be radiated further to the front side while a width of a radiation pattern is reduced. In other words, in comparison with the radio signal radiated from the antenna structure 110, the radio signal radiated from the antenna apparatus 100 may be more focused on the front side thereof.

Therefore, the antenna apparatus 100 having the lens 120 may form a radiation pattern which is focused to the front side, and the vehicle 1 may perform various beam forming by use of the characteristics of the antenna apparatus 100.

Figure 11:
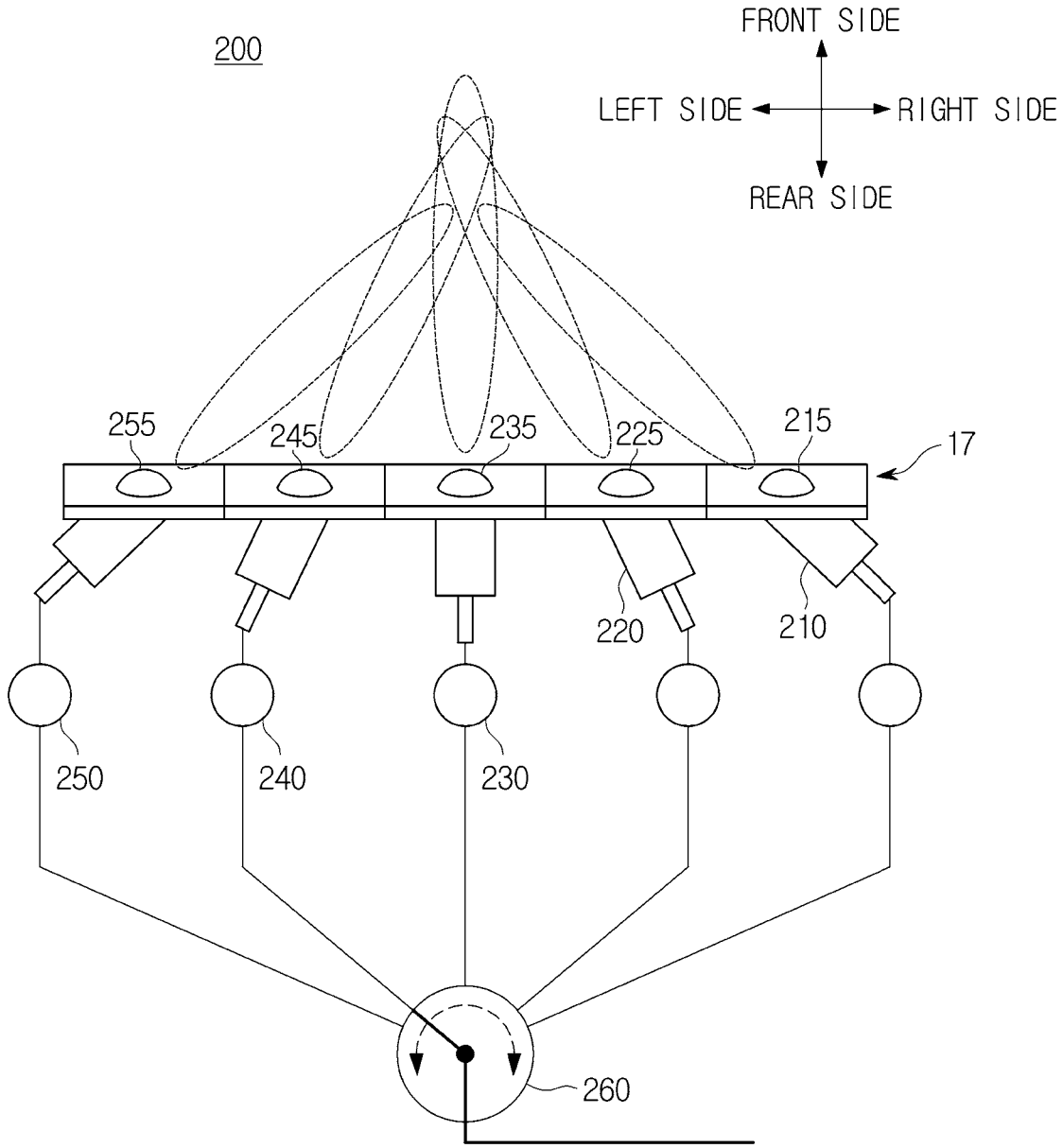
FIG. 11 is a view illustrating an antenna apparatus in accordance with other embodiment.

FIG. 11 is a view illustrating an antenna apparatus in accordance with other embodiment.

Referring to FIG. 11, an antenna apparatus 200 may include a plurality of antenna structures 210 to 250, a plurality of lenses 215 to 255 and a switcher 260. For example, the antenna apparatus 200 may include a first antenna structure 210, a second antenna structure 220, a third antenna structure 230, a fourth antenna structure 240, a fifth antenna structure 250, a first lens 215, a second lens 225, a third lens 235, a fourth lens 245, and a fifth lens 255.

The plurality of lenses 215 to 255 may be disposed in line in the windows 17 and 19 of the vehicle 1, respectively and the plurality of antenna structures 210 to 250 may be disposed in line on a rear surface (flat surface) of the plurality of lenses 215 to 255. For example, the first antenna structure 210 may be disposed on the rear surface of the first lens 215, the second antenna structure 220 may be disposed on the rear surface of the second lens 225, the third antenna structure 230 may be disposed on the rear surface of the third lens 235, the fourth antenna structure 240 may be disposed on the rear surface of the fourth lens 245, and the fifth antenna structure 250 may be disposed on the rear surface of the fifth lens 255.

The central axis of the plurality of lenses 215 to 255 may substantially coincide with the plurality of antenna structures 210 to 250, respectively.

Directions in which the plurality of antenna structures 210 to 250 radiates a radio frequency signal may be different from each other.

For example, the third antenna structure 230, which is located at the center among the plurality of antenna structures 210 to 250, may radiate a radio signal toward the front side D3 of the vehicle 1.

The second antenna structure 220 located on the right side of the third antenna structure 230 may radiate a radio signal in a direction D2 tilted from the front side of the vehicle 1 to the left side thereof. The second antenna structure 220 may radiate a radio signal in a direction which is close to the radio signal radiated from the third antenna structure 230.

The first antenna structure 210 located on the right side of the second antenna structure 220 may radiate a radio signal in a direction D1 more tilted than the second antenna structure 220 to the left side thereof. The first antenna structure 210 may radiate a radio signal in a direction which is closer to the radio signals radiated from the third and second antenna structures 230 and 220.

The fourth antenna structure 240 located on the left side of the third antenna structure 230 may radiate a radio signal in a direction D4 tilted from the front side of the vehicle 1 to the right side thereof. The fourth antenna structure 240 may radiate a radio signal in a direction which is close to the radio signal radiated from the third antenna structure 230.

The fifth antenna structure 250 located on the left side of the fourth antenna structure 240 may radiate a radio signal in a direction D5 more tilted than the fourth antenna structure 240 to the right side thereof. The fifth antenna structure 250 may radiate a radio signal in a direction which is closer to the radio signals radiated from the third and fourth antenna structures 230 and 240.

As mentioned above, the plurality of antenna structures 210 to 250 may radiate a radio signal towards a certain point in the front side of the vehicle 1, and the plurality of lenses 215 to 255 may improve the directivity of the radio signal radiated from the plurality of antenna structures 210 to 250.

The switcher 260 may be provided between the plurality of antenna structures 210 to 250, and the radar device 40/the wireless communication device 50. The switcher 260 may connect one or two or more antenna structure among the plurality of antenna structures 210 to 250, to the radar device 40/the wireless communication device 50.

The switcher 260 may transmit a transmission signal output from the radar device 40/the wireless communication device 50, to one or two or more antenna structure among the plurality of antenna structures 210 to 250, and output a reception signal output from the one or two or more antenna structure among the plurality of antenna structures 210 to 250, to the radar device 40/the wireless communication device 50.

Figure 12:
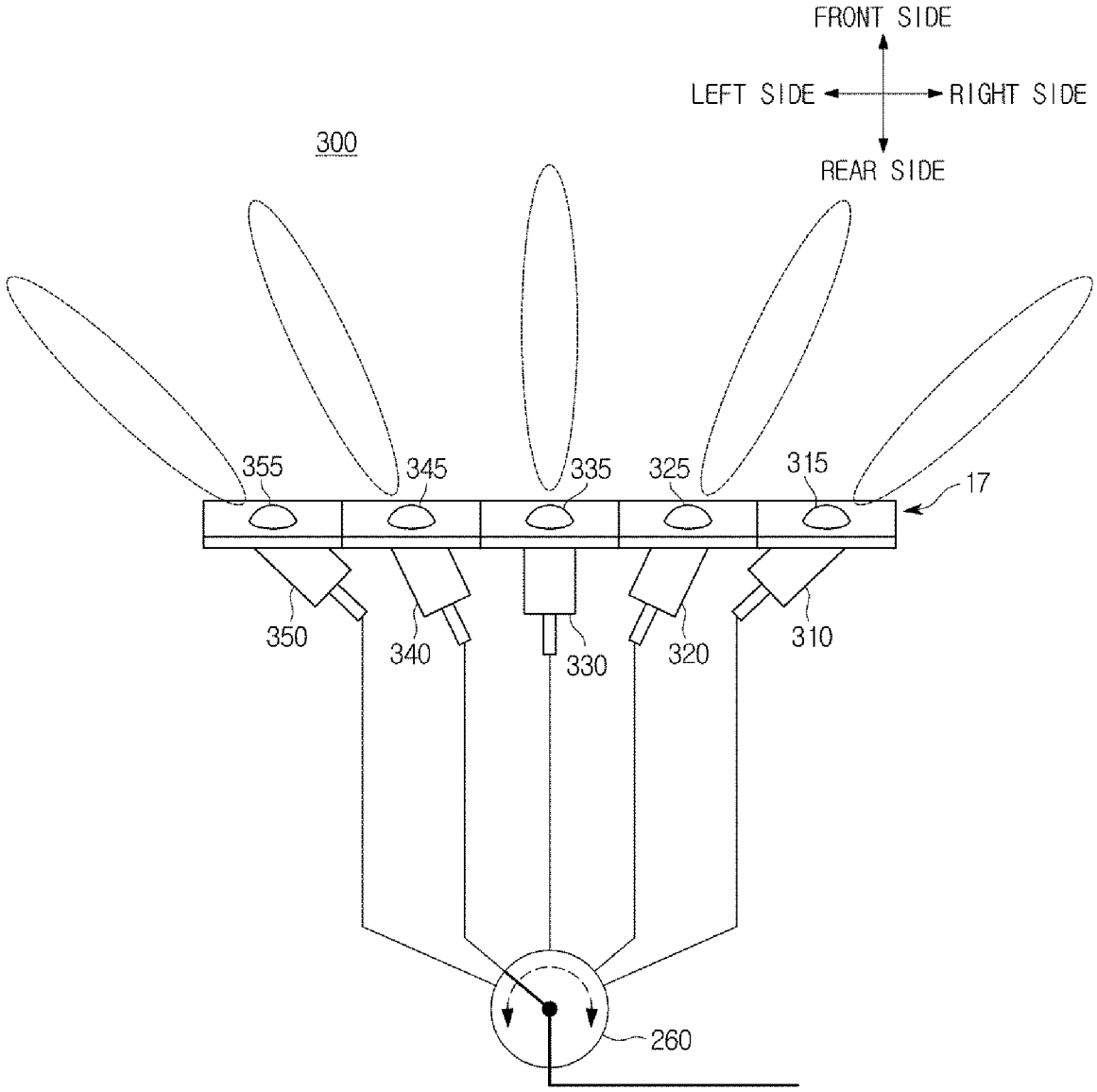
FIG. 12 is a view illustrating an antenna apparatus in accordance with other embodiment.

FIG. 12 is a view illustrating an antenna apparatus in accordance with other embodiment.

Referring to FIG. 12, an antenna apparatus 300 may include a plurality of antenna structures 310 to 350, a plurality of lenses 315 to 355 and a switcher 360.

The plurality of lenses 315 to 355 may be disposed in line in the windows 17 and 19 of the vehicle 1, respectively and the plurality of antenna structures 310 to 350 may be disposed in line on a rear surface (flat surface) of the plurality of lenses 315 to 355.

The central axis of the plurality of lenses 315 to 355 may substantially coincide with the plurality of antenna structures 310 to 350, respectively.

Directions in which the plurality of antenna structures 310 to 350 radiates a radio frequency signal may be different from each other.

For example, the third antenna structure 330, which is located at the center among the plurality of antenna structures 310 to 350, may radiate a radio signal toward the front side D3 of the vehicle 1.

The second antenna structure 320 located on the right side of the third antenna structure 330 may radiate a radio signal in a direction D2 tilted from the front side of the vehicle 1 to the right side thereof. The second antenna structure 320 may radiate a radio signal in a direction which is away from the radio signal radiated from the third antenna structure 330.

The first antenna structure 310 located on the right side of the second antenna structure 320 may radiate a radio signal in a direction D1 more tilted than the second antenna structure 320 to the right side thereof. The first antenna structure 310 may radiate a radio signal in a direction which is more away from the radio signals radiated from the third and second antenna structures 330 and 320.

The fourth antenna structure 340 located on the left side of the third antenna structure 330 may radiate a radio signal in a direction D4 tilted from the front side of the vehicle 1 to the left side thereof. The fourth antenna structure 340 may radiate a radio signal in a direction which is away from the radio signal radiated from the third antenna structure 330.

The fifth antenna structure 350 located on the left side of the fourth antenna structure 340 may radiate a radio signal in a direction D5 more tilted than the fourth antenna structure 340 to the right side thereof. The fifth antenna structure 350 may radiate a radio signal in a direction which is more away from the radio signals radiated from the third and fourth antenna structures 330 and 340.

As mentioned above, the plurality of antenna structures 310 to 350 may radially radiate a radio signal to the front side of the vehicle 1, and the plurality of lenses 315 to 355 may improve the directivity of the radio signal radiated from the plurality of antenna structures 310 to 350.

The switcher 360 may be provided between the plurality of antenna structures 310 to 350, and the radar device 40/the wireless communication device 50. The switcher 360 may connect one or two or more antenna structure among the plurality of antenna structures 310 to 350, to the radar device 40/the wireless communication device 50.

The radiation pattern (The radiation direction) of the radio signal radiated from the antenna apparatus 300 may be changed according to the operation of the switcher 360. For example, when the third antenna structure 330 and the radar device 40/the wireless communication device 50 are connected by the switcher 360, the antenna apparatus 300 may radiate a radio signal formed in the shape of protruding toward the front side of the vehicle 1. Furthermore, when the first antenna structure 310 and the radar device 40/the wireless communication device 50 are connected by the switcher 360, the antenna apparatus 300 may radiate a radio signal formed in the shape of protruding toward the front right side of the vehicle 1, and when the fifth antenna structure 350 and the radar device 40/the wireless communication device 50 are connected by the switcher 360, the antenna apparatus 300 may radiate a radio signal formed in the shape of protruding toward the front left side of the vehicle 1.

Figure 13:
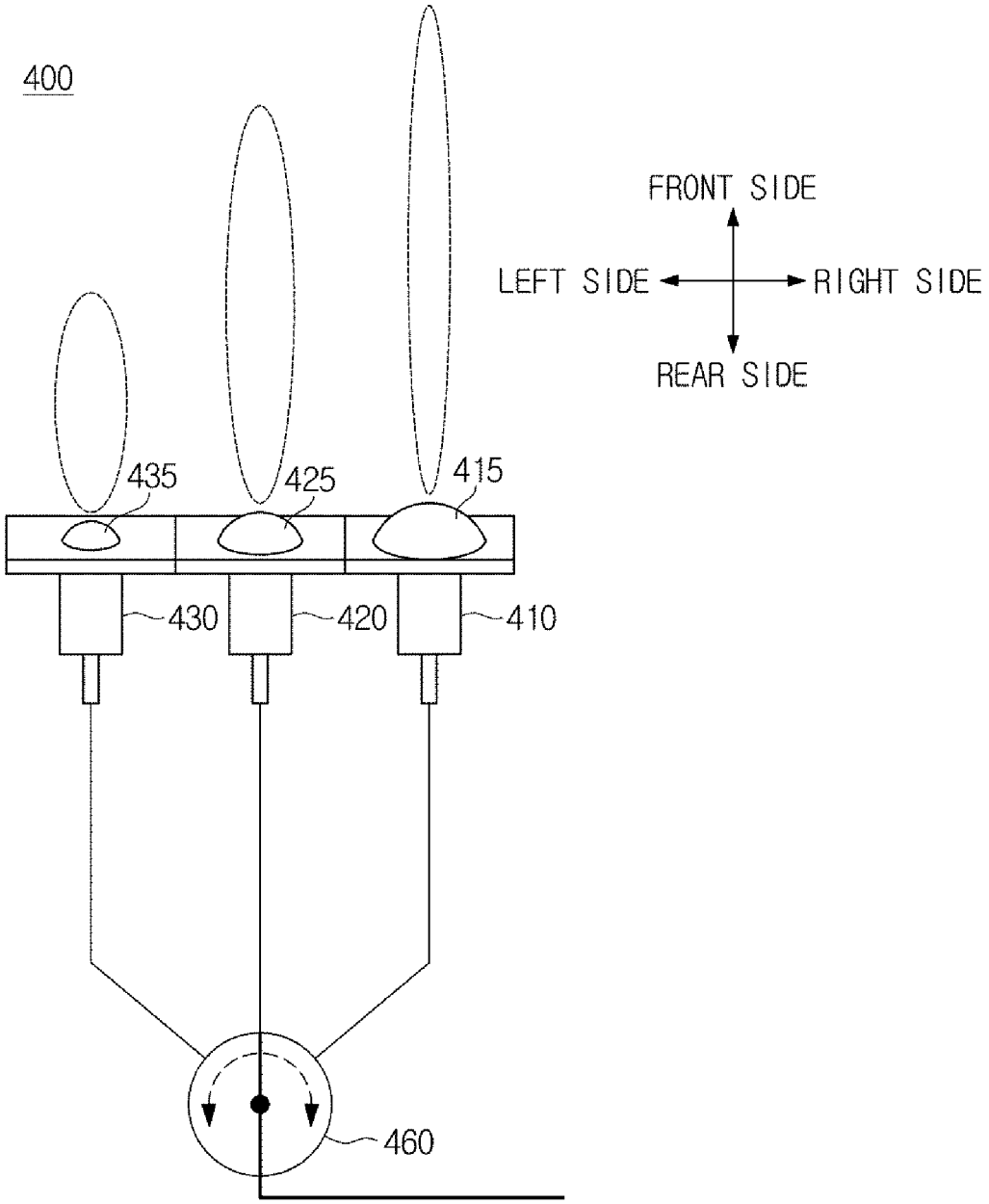
FIG. 13 is a view illustrating an antenna apparatus in accordance with other embodiment.

FIG. 13 is a view illustrating an antenna apparatus in accordance with other embodiment.

Referring to FIG. 13, an antenna apparatus 400 may include a plurality of antenna structures 410 to 430, a plurality of lenses 415 to 435 and a switcher 460. For example, the antenna apparatus 400 may include a first antenna structure 410, a second antenna structure 420, a third antenna structure 430, a first lens 415, a second lens 425, and a third lens 435.

The plurality of lenses 415 to 435 may be disposed in line in the windows 17 and 19 of the vehicle 1, respectively and the plurality of antenna structures 410 to 430 may be disposed in line on a rear surface (flat surface) of the plurality of lenses 415 to 435.

The central axis of the plurality of lenses 415 to 435 may substantially coincide with the plurality of antenna structures 410 to 430, respectively.

All of the plurality of antenna structures 410 to 430 may radiate radio signals in the same direction thereof. For example, all of the plurality of antenna structures 410 to 430 may radiate radio signals toward the front side thereof.

The plurality of lenses 415 to 435 may be a plano-convex lens having a convex surface and a flat surface, wherein a radius of curvature of the convex surface of the plurality of lenses 415 to 435 may be different from each other. A focal length of the plurality of lenses 415 to 435 may be different from each other according to the radius of curvature of the convex surface of the plurality of lenses 415 to 435, and the radiation pattern of the radio signal may be different from each other according to the radius of curvature of the convex surface of the plurality of lenses 415 to 435.

For example, a position on which a radio signal radiated from the plurality of antenna structures 410 to 430 is focused may be different from each other according to the radius of curvature of the convex surface of the plurality of lenses 415 to 435. In other words, the maximum gain and the half-power beam-width (HPBW) of the radio signal radiated from the antenna structures 410 to 430 may be different from each other according to the radius of curvature of the convex surface of the plurality of lenses 415 to 435.

A diameter of the plurality of lenses 415 to 435 may be different from each other. The radiation patterns of the radio signals may be different according to the diameter of the plurality of lenses 415 to 435.

For example, a position to which a radio signal radiated from the plurality of antenna structures 410 to 430 is focused may be different from each other according to the diameter of the plurality of lenses 415 to 435. In other words, the maximum gain and the half-power beam-width (HPBW) of the radio signal radiated from the antenna structures 410 to 430 may be different from each other according to the diameter of the plurality of lenses 415 to 435.

The switcher 460 may be provided between the plurality of antenna structures 410 to 430, and the radar device 40/the wireless communication device 50. The switcher 460 may connect one or two or more antenna structure among the plurality of antenna structures 410 to 430, to the radar device 40/the wireless communication device 50.

The radiation pattern of the radio signal radiated from the antenna apparatus 400 may be changed according to the operation of the switcher 460. For example, when the first antenna structure 410 and the radar device 40/the wireless communication device 50 are connected by the switcher 460, the antenna apparatus 400 may radiate a radio signal formed in the shape of protruding toward the front side of the vehicle 1. Furthermore, when the third antenna structure 430 and the radar device 40/the wireless communication device 50 are connected by the switcher 460, a transmission distance of the radio signal radiated by the antenna apparatus 400 may be less than the radio signal of the first antenna structure 410 and the half-power beam-width (HPBW) of the radio signal radiated by the antenna apparatus 100 may be wider than the radio signal of the first antenna structure 410.

As is apparent from the above description, according to the provided antenna apparatus and vehicle having the same, it may be possible to radiate radio waves in various beam shapes and in various directions, by use of a lens.

It may be possible to radiate radio waves in various beam shapes and in various directions, by use of the window of the vehicle as a lens.

By use of the window of the vehicle as a lens, it may be possible to reduce the loss such as rotation and reflection caused by the lens.

By use of the window of the vehicle as a lens, it may be possible to easily process the lens.

By use of the window of the vehicle as a lens, it may be possible to install the antenna apparatus in the front portion and the rear portion of the vehicle.

For convenience in explanation and accurate definition in the appended claims, the terms "upper", "lower", "internal", "outer", "up", "down", "upper", "lower", "upwards", "downwards", "front", "rear", "back", "inside", "outside", "inwardly", "outwardly", "internal", "external", "internal", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vehicle comprising:

a body provided with a front window and a rear window;

a plurality of lenses formed on at least one of the front window and the rear window and provided with a first surface and a second surface;

a plurality of antennae disposed on the second surface of the lenses to radiate a radio signal passing through the plurality of lenses; and a switcher configured to select at least one antenna among the plurality of antennae to allow the at least one antenna among the plurality of antennae to radiate the radio signal.

2. The vehicle of claim 1, wherein the plurality of lenses is integrally formed with at least one of the front window and the rear window.

3. The vehicle of claim 1, wherein the first surface of the plurality of lenses is a convex surface and the second surface of the plurality of lenses is a flat surface.

4. The vehicle of claim 1, wherein a radiation direction in which each of the plurality of antennae radiates the radio signal, is different from each other.

5. The vehicle of claim 1, wherein each of the plurality of antennae radiates the radio signal toward a predetermined point in a front side of the body.

6. The vehicle of claim 5, wherein the plurality of antennae includes a first antenna, a second antenna disposed on a left side of the first antenna, and a third antenna disposed on a right side of the first antenna, and the first antenna radiates a radio signal to the front side of the body, the second antenna radiates the radio signal to a front right side of the body, and the third antenna radiates the radio signal to a front left side of the body.

7. The vehicle of claim 1, wherein the plurality of antennae radially radiates the radio signal to a front side of the body.

8. The vehicle of claim 7, wherein the plurality of antennae includes a first antenna, a second antenna disposed on a left side of the first antenna, and a third antenna disposed on a right side of the first antenna, and the first antenna radiates the radio signal to a front side of the body, the second antenna radiates the radio signal to a front left side of the body, and the third antenna radiates the radio signal to a front right side of the body.

9. The vehicle of claim 1, wherein the first surface of each of the plurality of lenses is a convex surface, and a radius of curvature of the convex surface of the plurality of lenses is different from each other.

10. The vehicle of claim 1, wherein a diameter of each of the plurality of lenses is different from each other.

11. An antenna apparatus for a vehicle comprising:

a plurality of lenses formed on at least one of a front window and a rear window of the vehicle and provided with a first surface and a second surface;

a plurality of antennae disposed on the second surface of the lenses and to radiate a radio signal passing through the plurality of lenses; and a switcher configured to select at least one antenna among the plurality of antennae to allow the at least one antenna among the plurality of antennae to radiate the radio signal.

12. The antenna apparatus for the vehicle of claim 11, wherein the plurality of lenses is integrally formed with at least one of the front window and the rear window.

13. The antenna apparatus for the vehicle of claim 11, wherein the first surface of the plurality of lenses is a convex surface and the second surface of the plurality of lenses is a flat surface.

14. The antenna apparatus for the vehicle of claim 11, wherein a radiation direction in which each of the plurality of antennae radiates the radio signal, is different from each other.

15. The antenna apparatus for the vehicle of claim 11, wherein each of the plurality of antennae radiates the radio signal toward a predetermined point in a front side of the body.

16. The antenna apparatus for the vehicle of claim 15, wherein the plurality of antennae includes a first antenna, a second antenna disposed on a left side of the first antenna, and a third antenna disposed on a right side of the first antenna, and the first antenna radiates the radio signal to a front side of the vehicle, the second antenna radiates the radio signal to a front right side of the vehicle, and the third antenna radiates the radio signal to a front left side of the vehicle.

17. The antenna apparatus for the vehicle of claim 11, wherein the plurality of antennae radially radiates the radio signal to a front side of the body.

18. The antenna apparatus for the vehicle of claim 17, wherein the plurality of antennae includes a first antenna, a second antenna disposed on a left side of the first antenna, and a third antenna disposed on a right side of the first antenna, and the first antenna radiates the radio signal to a front side of the vehicle, the second antenna radiates the radio signal to a front left side of the vehicle, and the third antenna radiates the radio signal to a front right side of the vehicle.

19. The antenna apparatus for the vehicle of claim 11, wherein the first surface of each of the plurality of lenses is a convex surface, wherein a radius of curvature of the convex surface of the plurality of lenses is different from each other.

20. The antenna apparatus for the vehicle of claim 11, wherein a diameter of each of the plurality of lenses is different from each other.

* * * * *